United States Patent [19]

Kayanuma

[11] Patent Number: 4,964,272

[45] Date of Patent: Oct. 23, 1990

[54] AIR-FUEL RATIO FEEDBACK CONTROL SYSTEM INCLUDING AT LEAST DOWNSTREAMSIDE AIR-FUEL RATIO SENSOR

[75] Inventor: Nobuaki Kayanuma, Gotenba, Japan

[73] Assignee: Toyota Jidosha Kabushiki Kaisha, Japan

[21] Appl. No.: 220,790

[22] Filed: Jul. 18, 1988

[30] Foreign Application Priority Data

Jul. 20, 1987 [JP] Japan ..... 62-179173

[51] Int. Cl.[5] ..... F02D 41/14

[52] U.S. Cl. ..... 60/274; 60/276; 60/285; 123/489

[58] Field of Search ..... 123/440, 489, 589; 60/274, 276, 285

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,077,364 | 3/1978 | Aoki | 123/489 |
| 4,089,313 | 5/1978 | Asano et al. | 123/489 |
| 4,111,162 | 9/1978 | Norimatsu et al. | 123/489 |
| 4,127,088 | 11/1978 | Ezoe | 123/440 |
| 4,130,095 | 12/1978 | Bowler et al. | 123/440 |
| 4,177,787 | 12/1979 | Hattori et al. | 123/440 |
| 4,178,884 | 12/1979 | Norimatsu et al. | 123/489 |
| 4,235,204 | 11/1980 | Rice | 123/440 |
| 4,244,340 | 1/1981 | Herth et al. | 123/440 |
| 4,251,989 | 2/1981 | Norimatsu et al. | 123/440 |
| 4,401,086 | 8/1983 | Miyagi | 123/489 |
| 4,462,373 | 7/1984 | Kanno | 123/489 |
| 4,475,517 | 10/1984 | Kobayashi et al. | 123/489 |
| 4,502,443 | 3/1985 | Hasegawa et al. | 123/440 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |
| 4,693,076 | 9/1987 | Chujo et al. | 60/274 |
| 4,707,985 | 11/1987 | Nagai et al. | 60/274 |
| 4,712,373 | 12/1987 | Nagai et al. | 60/274 |
| 4,720,973 | 1/1988 | Katsuno | 60/274 |
| 4,811,557 | 3/1989 | Okumura et al. | 123/489 |

FOREIGN PATENT DOCUMENTS

| | | | |
|---|---|---|---|
| 52-102934 | 8/1977 | Japan . | |
| 53-103796 | 9/1978 | Japan . | |
| 55-37562 | 3/1980 | Japan . | |
| 57-32772 | 7/1982 | Japan . | |
| 57-32773 | 7/1982 | Japan . | |
| 57-32774 | 7/1982 | Japan . | |
| 57-135243 | 8/1982 | Japan | 123/440 |
| 58-27848 | 2/1983 | Japan . | |
| 58-48755 | 3/1983 | Japan . | |
| 58-48756 | 3/1983 | Japan . | |
| 58-53661 | 3/1983 | Japan . | |
| 58-72646 | 4/1983 | Japan . | |
| 58-72647 | 4/1983 | Japan . | |
| 58-135343 | 8/1983 | Japan . | |
| 58-150038 | 9/1983 | Japan . | |
| 58-150039 | 9/1983 | Japan . | |
| 58-152147 | 9/1983 | Japan . | |
| 59-32644 | 2/1984 | Japan . | |
| 59-206638 | 11/1984 | Japan . | |
| 60-1340 | 1/1985 | Japan . | |
| 60-26138 | 2/1985 | Japan . | |
| 60-53635 | 3/1985 | Japan . | |
| 61-34330 | 2/1986 | Japan . | |
| 61-53436 | 3/1986 | Japan . | |
| 61-232346 | 10/1986 | Japan . | |

*Primary Examiner*—Andrew M. Dolinar

[57] ABSTRACT

In an air-fuel ratio feedback control system including at least one air-fuel ratio sensor downstream of a catalyst converter provided in an exhaust gas passage, an actual air-fuel ratio is controlled in accordance with the output of the downstream-side air-fuel ratio sensor. When the engine is transferred from an open loop control state such as a fuel cut-off state or an OTP incremental state to an air-fuel ratio feedback control state for a stoichiometric air-fuel ratio by the downstream-side air-fuel ratio sensor, the speed of changing an air-fuel ratio correction amount in accordance with the output of the downstream-side air-fuel ratio sensor is at a conventional speed before the switching of the output of the downstream-side air-fuel ratio sensor, but thereafter (only immediately after the switching of the output of the downstream-side air-fuel ratio sensor or for a predetermined time period), this speed is increased.

32 Claims, 19 Drawing Sheets

| Fig. 3A | Fig. 3B | Fig. 3C |
|---|---|---|

LEAN
RICH
A/F
TDR
CDLY 0
t1
t2
t3
t4
t5
t6
t7
t8
TDL
A/F'
(F1)
TDR
(-TDL)

LEAN
RICH
TDR
KIR
FAF1

RSL
RSR
KIL

| Fig. 7A | Fig. 7B | Fig. 7C |
|---|---|---|

| Fig.10A | Fig.10B | Fig.10C |
|---|---|---|

LEAN DRIVING STATE (O/L)
A/F FEEDBACK CONTROL FOR DOWNSTREAM-SIDE $O_2$ SENSOR
$t_1$
$t_2$
$t_3$
$t_4$

LEAN
λ=1
RICH
UPSTREAM A/F
PRESENT INVENTION $V_{R2}$
$V_2$
PRIOR ART
PRESENT INVENTION

"1"
"0"
F2
RICH
LEAN

"1"
"0"
FL

RSR
kΔRS
PRIOR ART
PRESENT INVENTION

KIR
PRIOR ART
PRESENT INVENTION

AIR-FUEL RATIO FEEDBACK CONTROL SYSTEM INCLUDING AT LEAST DOWNSTREAMSIDE AIR-FUEL RATIO SENSOR

BACKGROUND OF THE INVENTION (1) Field of the Invention

The present invention relates to a method and apparatus for feedback control of an air-fuel ratio in an internal combustion engine having at least one air-fuel ratio sensor downstream of a catalyst converter disposed within an exhaust gas passage.

(2) Description of the Related Art

Generally, in a feedback control of the air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio.

According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_X$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. Nos. 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor in addition to an air-fuel ratio control operation carried out by the upstream-side $O_2$ sensor In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream side $O_2$ sensor.

(3) On the downstream side of the catalyst converter, the exhaust gas is mixed so that the of oxygen in the exhaust gas is approximately in an equilibrium state.

Therefore, according to the double $O_2$ sensor system, the fluctuation of the output of the upstream-side $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, for example, an air-fuel ratio feedback control parameter such as a rich skip amount RSR and/or a lean skip amount RSL is calculated in accordance with the output of the downstream-side $O_2$ sensor, and an air-fuel ratio correction amount FAF is calculated in accordance with the output of the upstream-side $O_2$ sensor and the air-fuel ratio feedback control parameter (see: U.S. Pat. No. 4,693,076). In this case, the air-fuel ratio feedback control parameter is stored in a backup random access memory (RAM). Therefore, when the engine is brought to an open loop control state for the downstream-side $O_2$ sensor, such as a fuel cut-off state, a partial lean driving state, an overtemperature preventing fuel incremental state (FOTP), a power fuel incremental state (FPOWER), or a non-activation state of the downstream-side $O_2$ sensor 15, to stop the calculation of the air-fuel ratio feedback control parameter by the downstream-side $O_2$ sensor, the air-fuel ratio correction amount FAF is calculated in accordance with the output of the upstream-side $O_2$ sensor and the air-fuel ratio feedback control parameter which was calculated in an activation state of the downstream-side $O_2$ sensor (i.e., an air-fuel ratio feedback control mode for the downstream-side $O_2$ sensor) and was stored in the backup RAM.

In the above-mentioned double $O_2$ sensor system, however, when the engine is switched from an open loop control state for the downstream-side $O_2$ sensor to an air fuel ratio feedback control state for the downstream-side $O_2$ sensor, to restart the calculation of the air-fuel ratio feedback control parameter, the air-fuel ratio feedback control parameter may be overcorrected, i.e., the controlled air-fuel ratio may be overcorrected.

For example, when the engine is in a fuel cut-off state or in a lean driving state for forcibly causing the engine to be in a lean air-fuel ratio, regardless of the output of the $O_2$ sensors, the three-way catalysts absorb $O_2$ molecules, and therefore, immediately after the engine returns to a driving state of the stoichiometric air-fuel ratio, the three-way catalysts expel the stored $O_2$ molecules therefrom. This is a so-called $O_2$ storage effect. As a result, even when the air-fuel ratio upstream of the catalyst converter is actually rich, the air-fuel ratio downstream of the catalyst converter is lean for a long time, so that the output of the downstream-side $O_2$ sensor indicates a lean state. Therefore, if an air-fuel ratio feedback control for the downstream-side $O_2$ sensor is carried out in a driving state of the stoichiometric air-fuel ratio, the air-fuel ratio feedback control parameter may be so large of small that an air-fuel ratio feedback control by the upstream-side $O_2$ sensor using the air-fuel ratio feedback control parameter produces an overrich air-fuel ratio, thus increasing the HC and CO emissions, and raising the fuel consumption.

For example, in a lean driving state (FOTP or FPOWER state) for forcibly causing the engine to be in a rich air-fuel ratio, even when the air-fuel ratio upstream of the catalyst converter is actually lean, the air-fuel ratio downstream of the catalyst converter is rich for a long time, so that the output of the downstream-side $O_2$ sensor indicates a rich state. Therefore, if an air-fuel ratio feedback control for the downstream-side $O_2$ sensor is carried out in a driving state of the stoichiometric air-fuel ratio, the air-fuel ratio feedback control parameter may be so large or small that an air-fuel ratio feedback control by the upstream-side $O_2$ sensor using the air-fuel ratio feedback control parameter produces an overlean air-fuel ratio, thus increasing the $NO_X$ emissions, and reducing the drivability characteristics.

The above-mentioned overrich or overlean air-fuel ratio problem is true for a single $O_2$ sensor system having only one $O_2$ sensor downstream of the catalyst converter.

SUMMARY OF THE INVENTION

It is an object of the present invention to provide an air-fuel ratio feedback control system including at least one air-fuel ratio sensor downstream of a catalyst converter, having improved exhaust emission and fuel consumption characteristics immediately after the control is transferred from an open-loop control state, such as a lean driving state or a rich driving state, for a downstream-side air-fuel ratio sensor to an air-fuel ratio feedback control mode for the downstream-side air-fuel ratio sensor.

According to the present invention, in an air-fuel ratio feedback control system including at least one air-fuel ratio sensor downstream of a catalyst converter provided in an exhaust gas passage, an actual air-fuel ratio is controlled in accordance with the output of the downstream-side air-fuel ratio sensor. When the engine is transferred from an open loop control state such as a fuel cut-off state or an OTP incremental state to an air-fuel ratio feedback control state for a stoichiometric air-fuel ratio by the downstream-side air-fuel ratio sensor, the speed of changing an air-fuel ratio correction amount FAF in accordance with the output of the downstream-side air-fuel ratio sensor is at a conventional speed before the switching of the output of the downstream-side air-fuel ratio sensor, but thereafter (only immediately after the switching of the output of the downstream-side air-fuel ratio sensor or for a predetermined time period), this speed is increased. Thus, the overcorrection of the air-fuel ratio correction amount FAF due to the long duration of the open loop control state is avoided.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
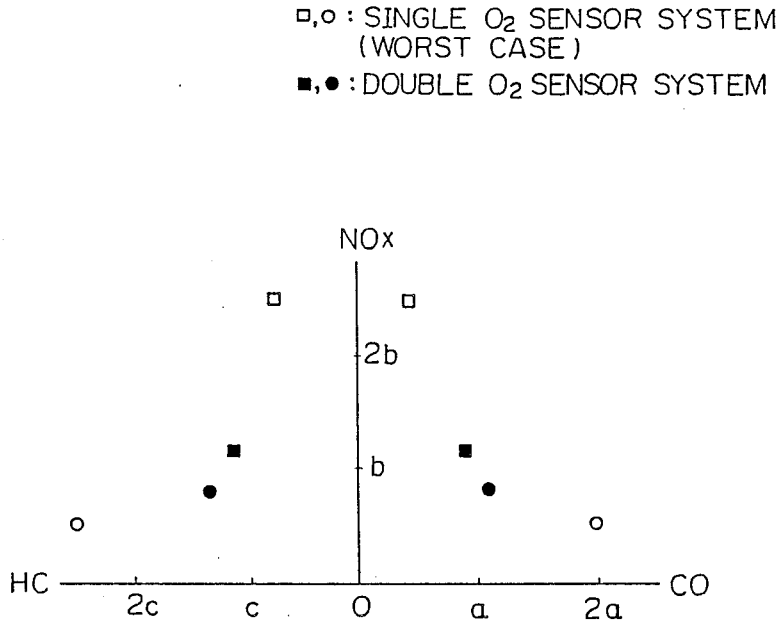
FIG. 1 is a graph showing the emission characteristics of a single $O_2$ sensor system and a double $O_2$ sensor system.
Figure 2:
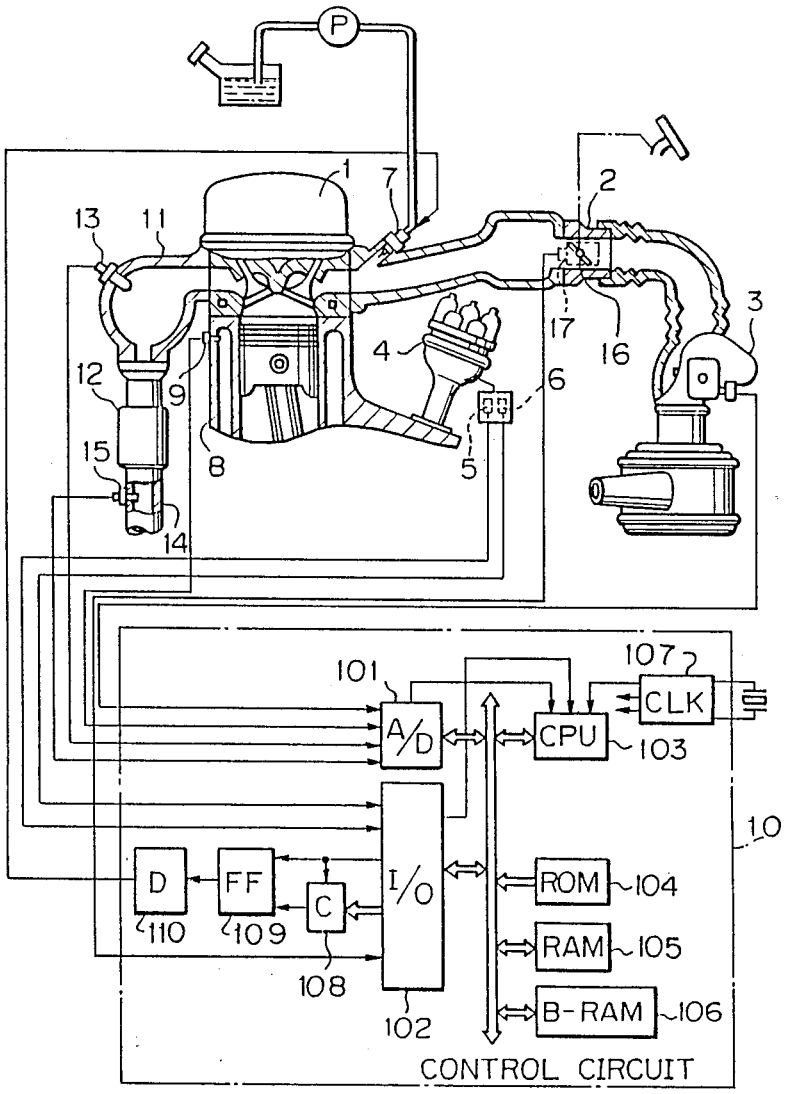
FIG. 2 is a schematic view of an internal combustion engine according to the present invention.

In FIG. 2, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air drawn into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1.

In this case, the crank angle sensor 5 generates a pulse signal at every 720° crank angle (CA) and the crank-angle sensor 6 generates a pulse signal at every 30° CA. The pulse signals of the crank angle sensors 5 and 6 are supplied to an input/output (I/O) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, but are not shown in FIG. 2.

Disposed in a cylinder block 8 of the engine 1 is a coolant temperature sensor 9 for detecting the temperature of the coolant. The coolant temperature sensor 9 generates an analog voltage signal in response to the temperature THW of the coolant and transmits that signal to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_X$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit those signals to the A/D converter 101 of the control circuit 10.

Reference 16 designates a throttle valve, and 17 an idle switch for detecting whether or not the throttle valve 16 is completely closed.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is not erased even when the ignition switch (not shown) is turned OFF.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 013 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature data THW of the coolant sensor 9 are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA, i.e., at every pulse signal of the crank angle sensor 6, and is then stored in the RAM 105.

The operation of the control circuit 10 of FIG. 2 will be now explained.

Figures 3, 3A:
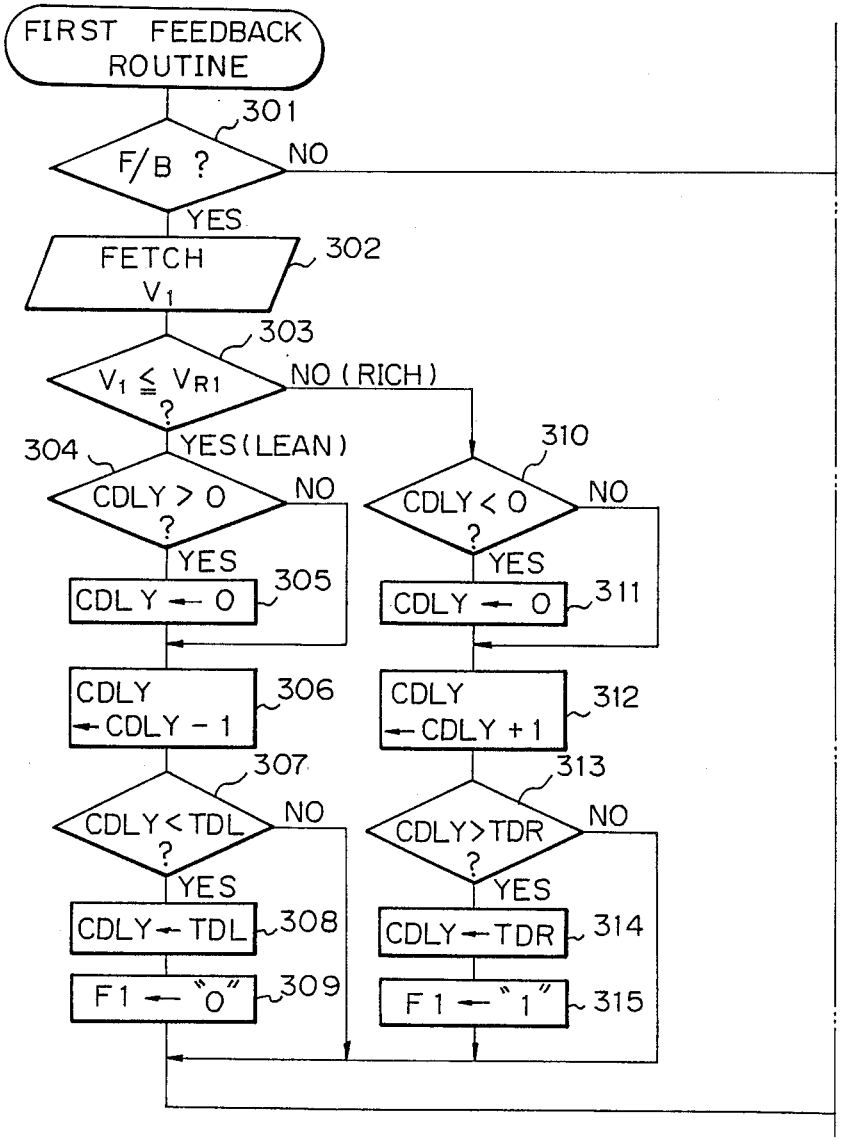
FIGS. 3, 3A–3C, 5, 6, 7, 7A–7C, 9, 10, 10A–10C, and 12 are flow charts showing the operation of the control circuit of FIG. 2.
Figure 3B:
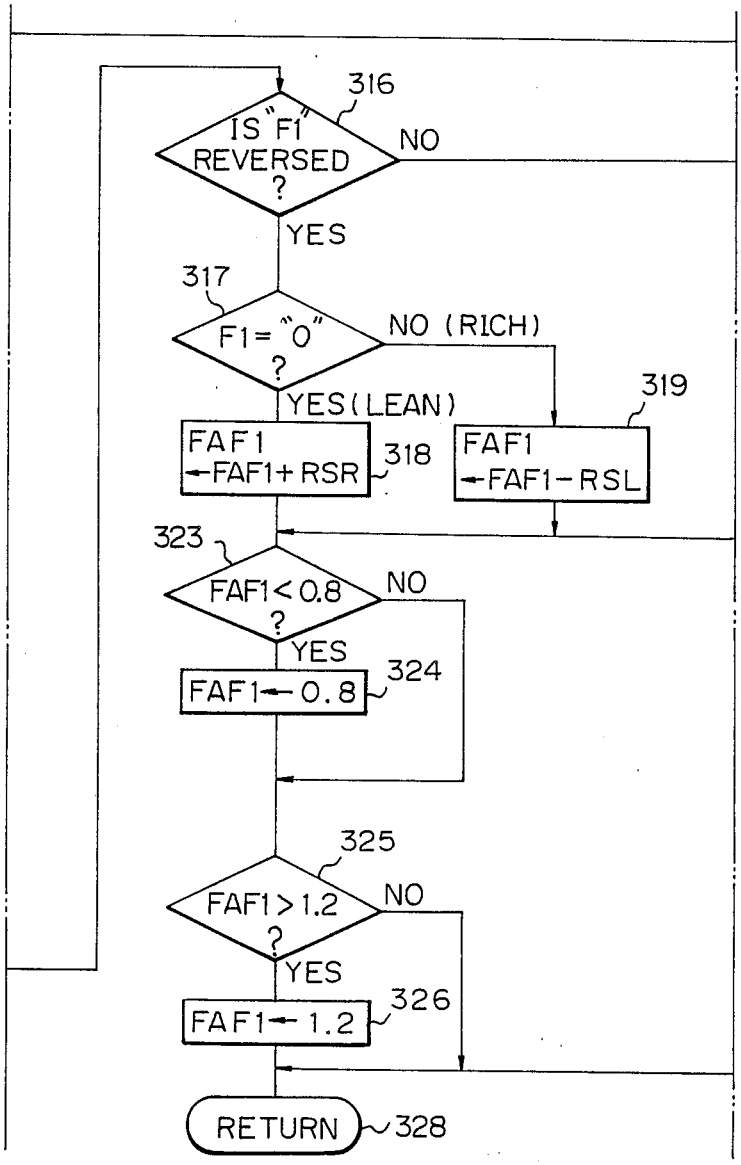
Figure 3C:
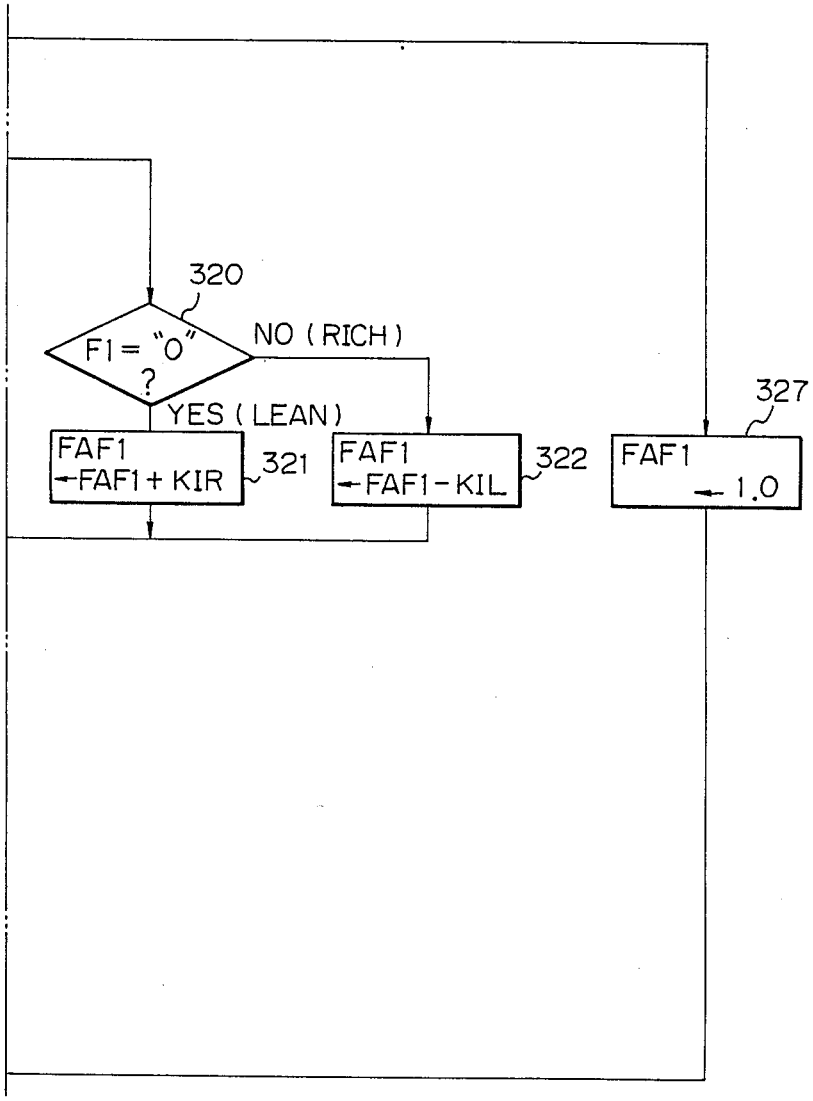

FIG. 3 is a routine for calculating a first air-fuel ratio feedback correction amount FAF1 in accordance with output of the upstream-side $O_2$ sensor 13 executed at every predetermined time period such as 4 ms.

At step 301, it is determined whether or not all of the feedback control (closed-loop control) conditions by the upstream-side $O_2$ sensor 13 are satisfied. The feedback control conditions are as follows:

(i) the coolant temperature is higher than 50° C.;

(ii) the engine is not in a starting state;

(iii) the engine is not in an enrichment state after the start of the engine;

(iv) the engine is not in a warming-up state;

(v) the overtemperature preventing fuel incremental amount FOTP is 0;

(vi) the power fuel incremental amount FPOWER is 0; and (vii) the upstream-side $O_2$ sensor 13 is in an activated state.

Note that the determination of activation/nonactivation of the upstream-side $O_2$ sensor 13 is carried out by determining whether or not the coolant temperature THW≧70° C., or by whether or not the output of the upstream-side $O_2$ sensor 13 is once swung, i.e., once changed from the rich side to the lean side, or vice versa. Of course, other feedback control conditions are introduced as occasion demands. However, an explanation of such other feedback control conditions is omitted.

If one of more of the feedback control conditions is not satisfied, the control proceeds to step 327, in which the amount FAF1 is caused to be 1.0 (FAF1=1.0), thereby carrying out an open-loop control operation. Note that, in this case, the amount FAF1 can be a value or a mean value immediately before the open-loop control operation. That is, the amount FAF1 or a mean value $\overline{FAF1}$ thereof is stored in the backup RAM 106, and an open-loop control operation, the value FAF1 or $\overline{FAF1}$ is read out of the backup RAM 106.

Contrary to the above, at step 301, if all of the feedback control conditions are satisfied, the control proceeds to step 302.

At step 302, an A/D conversion is performed upon the output voltage $V_1$ of the upstream-side $O_2$ sensor 13, and the A/D converted value thereof is then fetched from the A/D converter 101. Then at step 303, the voltage $V_1$ is compared with a reference voltage $V_{R1}$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq V_{R1}$, which means that the current air-fuel ratio is lean, the control proceeds to step 304, which determines whether or not the value of a delay counter CDLY is positive. If CDLY>0, the control proceeds to step 305, which clears the delay counter CDLY, and then proceeds to step 306. If CDLY≦0, the control proceeds directly to step 306. At step 306, the delay counter CDLY is counted down by 1, and at step 307, it is determined whether or not CDLY<TDL. Note that TDL is a lean delay time period for which a rich state is maintained even after the output of the upstream-side $O_2$ sensor 13 is changed from the rich side to the lean side, and is defined by a negative value. Therefore, at step 307, only when CDLY<TDL does the control proceed to step 308, which causes CDLY to be TDL, and then to step 309, which causes a first air-fuel ratio flag F1 to be "0" (lean state). On the other hand, if $V_1 > V_{R1}$, which means that the current air-fuel ratio is rich, the control proceeds to step 310, which determines whether or not the value of the delay counter CDLY is negative. If CDLY<0, the control proceeds to step 311, which clears the delay counter CDLY, and then proceeds to step 312. If CDLY≧0, the control directly proceeds to 312. At step 312, the delay counter CDLY is counted up by 1, and at step 313, it is determined whether or not CDLY>TDR. Note that TDR is a rich delay time period for which a lean state is maintained even after the output of the upstream-side $O_2$ sensor 13 is changed from the lean side to the rich side, and is defined by a positive value. Therefore, at step 313, only when CDLY>TDR does the control proceed to step 314, which causes CDLY to TDR, and then to step 315, which causes the first air-fuel ratio flag F1 to be "1" (rich state).

Next, at step 316, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed the control proceeds to steps 317 to 319, which carry out a skip operation.

At step 317, if the flag F1 is "0" (lean), the control proceeds to step 318, which remarkably increases the correction amount FAF1 by a skip amount RSR. Also, if the flag F1 is "1" (rich) at step 317, the control proceeds to step 319, which remarkably decreases the correction amount FAF1 by a skip amount RSL.

On the other hand, if the first air-fuel ratio flag F1 is not reversed at step 316, the control proceeds to steps 320 to 322, which carries out an integration operation. That is, if the flag F1 is "0" (lean) at step 320, the control proceeds to step 321, which gradually increases the correction amount FAF1 by a rich integration amount KIR. Also, if the flag F1 is "1" (rich) at step 320, the control proceeds to step 322, which gradually decreases the correction amount FAF1 by a lean integration amount KIL.

The correction amount FAF1 is guarded by a minimum value 0.8 at steps 323 and 324. Also, the correction amount FAF1 is guarded by a maximum value 1.2 at steps 325 and 326. Thus, the controlled air-fuel ratio is prevented from becoming overlean or overrich.

The correction amount FAF1 is then stored in the RAM 105, thus completing this routine of FIG. 3 at steps 328.

Figures 4A, 4B, 4C, 4D:
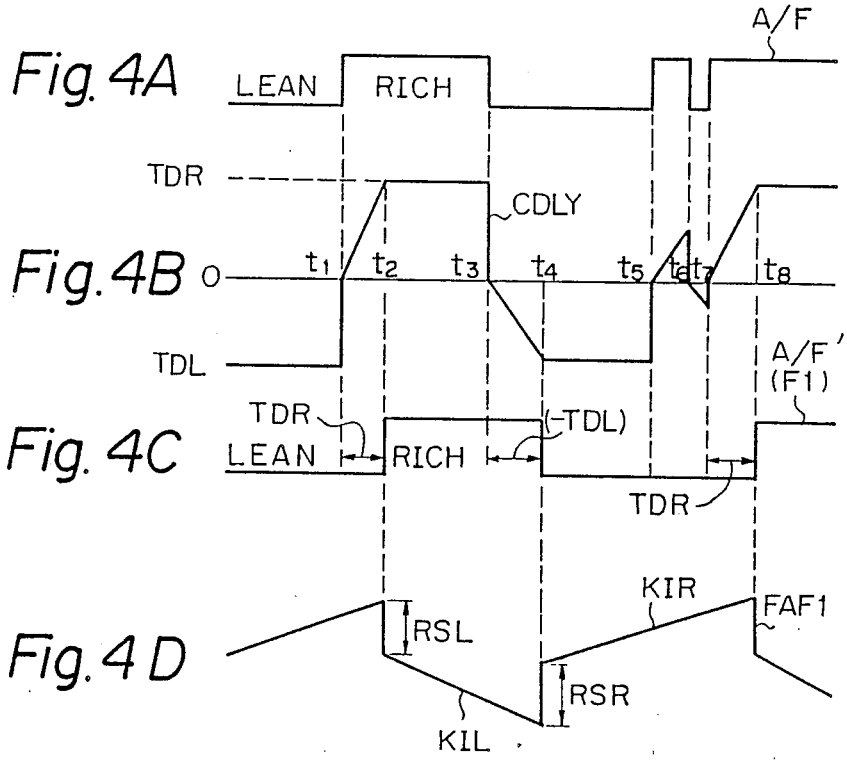
FIGS. 4A through 4D are tim diagrams explaining the flow chart of FIGS. 3 and 3A–3C.

The operation by the flow chart of FIG. 3 will be further explained with reference to FIGS. 4A through 4D. As illustrated in FIG. 4A, when the air-fuel ratio A/F is obtained by the output of the upstream-side $O_2$ sensor 13, the delay counter CDLY is counted up during a rich state, and is counted down during a lean state, as illustrated in FIG. 4B. As a result, a delayed air-fuel ratio corresponding to the first air-fuel ratio flag F1 is obtained as illustrated in FIG. 4C. For example, at time $t_1$, even when the air-fuel ratio A/F is changed from the lean side to the rich side, the delayed air-fuel ratio A/F' (F1) is changed at time $t_2$ after the rich delay time period TDR. Similarly, at time $t_3$, even when the air-fuel ratio A/F is changed from the rich side to the lean side, the delayed air-fuel ratio F1 is changed at time $t_4$ after the lean delay time period TDL. However, at time $t_5$, $t_6$, or $t_7$, when the air-fuel ratio A/F is reversed within a shorter time period than the rich delay time period TDR or the lean delay time period TDL, the delay air-fuel ratio A/F' is reversed at time $t_8$. That is, the delayed air-fuel ratio A/F' is stable when compared with the air-fuel ratio A/F. Further, as illustrated in FIG. 4D, at every change of the delayed air-fuel ratio A/F' from the rich side to the lean side, or vice versa, the correction amount FAF is skipped by the skip amount RSR or RSL, and in addition, the correction amount FAF1 is gradually increased or decreased in accordance with the delayed air-fuel ratio A/F'.

Air-fuel ratio feedback control operations by the downstream-side $O_2$ sensor 15 will be explained. There are two types of air-fuel ratio feedback control operations by the downstream-side $O_2$ sensor 15, i.e., the operation type in which a second air-fuel ratio correction amount FAF2 is introduced thereinto, and the operation type in which an air-fuel ratio feedback control parameter in the air-fuel ratio feedback control operation by the upstream-side $O_2$ sensor 13 is variable. Further, as the air-fuel ratio feedback control parameter, there are nominated a delay time period TD (in more detail, the rich delay time period TDR and the lean delay time period TDL), a skip amount RS (in more detail, the rich skip amount RSR and the lean skip amount RSL), an integration amount KI (in more detail, the rich integration amount KIR and the lean integration amount KIL), and the reference voltage $V_{R1}$.

For example, if the rich delay time period becomes longer than the lean delay time period (TDR>(−TDL)), the controlled air-fuel becomes richer, and if the lean delay time period becomes longer than the rich delay time period ((−TDL)>TDR), the controlled air-fuel ratio becomes leaner. Thus, the air-fuel ratio can be controlled by changing the rich delay time period TDR1 and the lean delay time period (−TDL) in accordance with the output of the downstream-side $O_2$ sensor 15. Also, if the rich skip amount RSR is increased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the output downstream-side $O_2$ sensor Further, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIL in accordance with the output of the downstream-side $O_2$ sensor 15. Still further, if the reference voltage $V_{R1}$ is increased, the controlled air-fuel ratio becomes richer, and if the reference voltage $V_{R1}$ is decreased, the controlled air-fuel ratio becomes leaner. Thus, the air-fuel ratio can be controlled by changing the reference voltage $V_{R1}$ in accordance with the output of the downstream-side $O_2$ sensor 15.

There are various merits in the control of the air-fuel ratio feedback control parameters by the output $V_2$ of the downstream-side $O_2$ sensor 15. For example, when the delay time periods TDR and TDL are controlled by the output $V_2$ of the downstream-side $O_2$ sensor 15, it is possible to precisely control the air-fuel ratio. Also, when the skip amounts RSR and RSL are controlled by the output $V_2$ of the downstream-side $O_2$ sensor 15, it is possible to improve the response speed of the air-fuel ratio feedback control by the output $V_2$ of the downstream-side $O_2$ sensor 15. Of course, it is possible to simultaneously control two or more kinds of the air-fuel ratio feedback control parameters by the output $V_2$ of the downstream-side $O_2$ sensor 15.

A double $O_2$ sensor system into which a second air-fuel ratio correction amount FAF2 is introduced will be explained with reference to FIGS. 5, 6, and 8.

Figure 5:
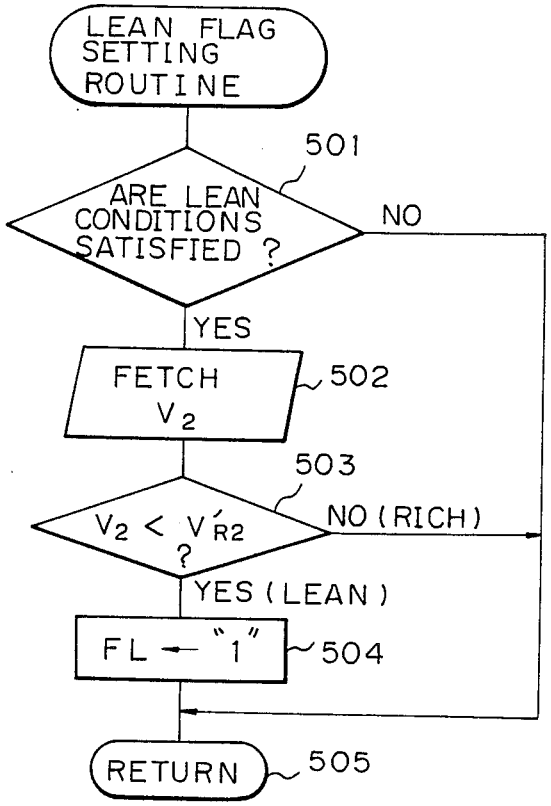
Figures 7, 7A:
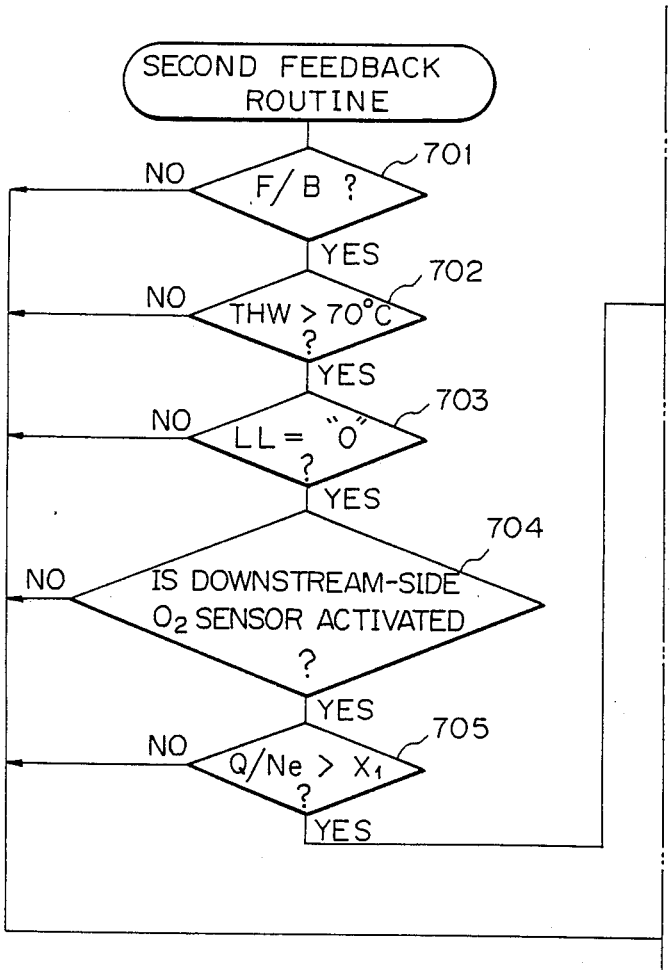
Figure 7B:
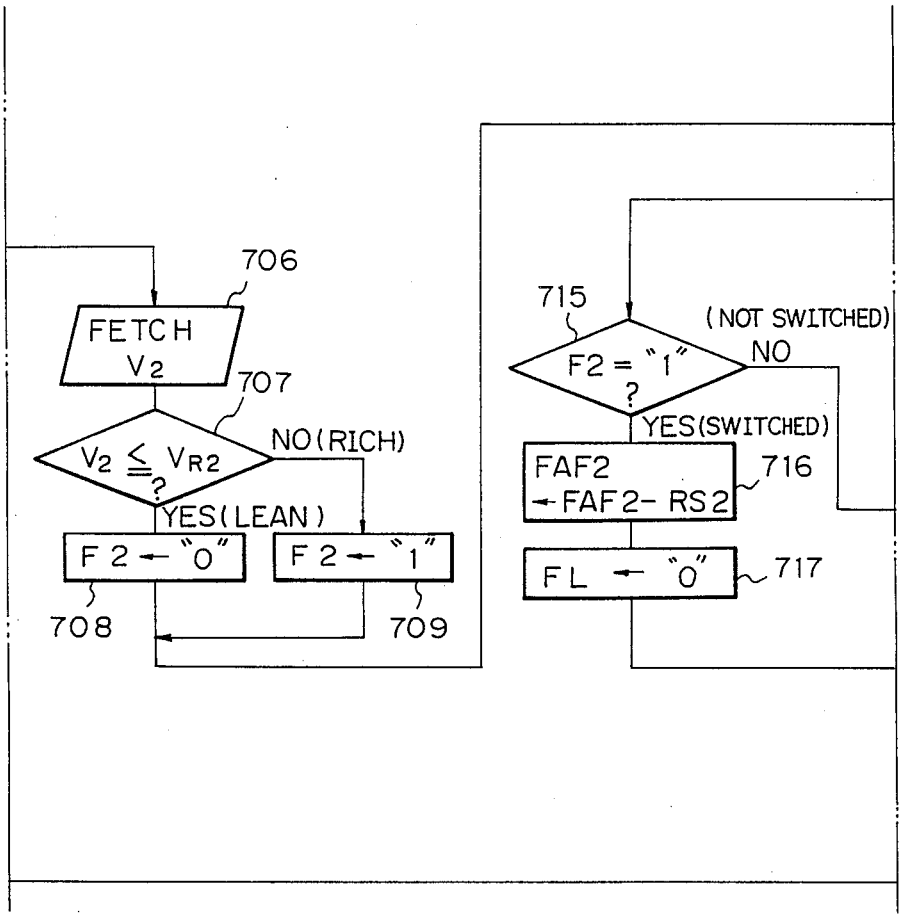
Figure 7C:
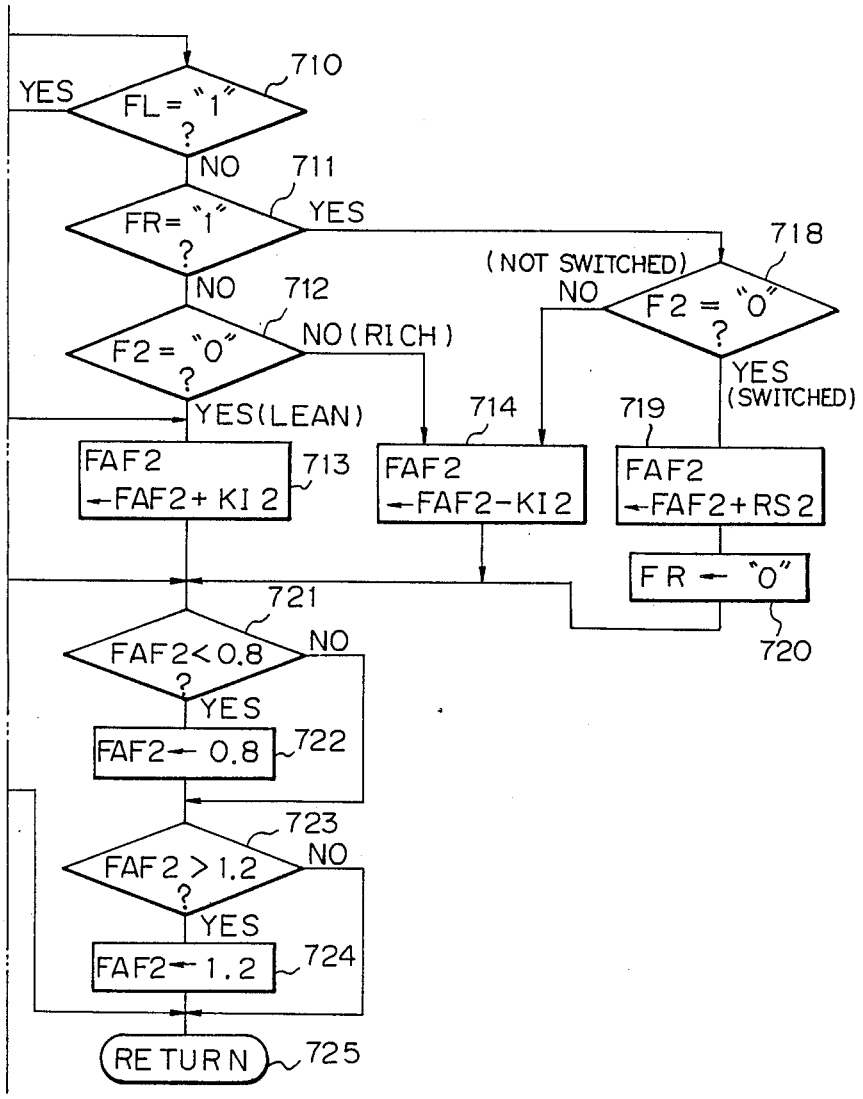

FIG. 5 is a routine for calculating a lean flag FL used in the routine of FIG. 7, executed at a predetermined time period such as 4 ms. That is, at step 501, it is determined whether or not the engine is in a lean driving state such as a fuel cut-off state which indicates an open loop control state for the $O_2$ sensors 13 and 15. Only if the engine is in a lean driving state, does the control proceed to step 502, which performs an A/D conversion upon the output $V_2$ of the downstream-side $O_2$ sensor 15, and fetches the A/D converted value. Then, at step 503, the output $V_2$ is compared with a reference voltage VR2. As a result, only if $V_2 < V_{R2}'$ (lean), the control proceeds to step 504 which sets the lean flag FL. Then, the control proceeds to step 505 thus completing the routine of FIG. 5.

Thus, the lean flag FL is set by determining that the air-fuel ratio downstream of the catalyst converter 12 is sufficiently lean under the condition of a lean driving state as an open loop control state. Note that the reference voltage $V_{R2}'$ at step 503 is lower, e.g., 0.2 to 0.4 V, compared with a reference voltage $V_{R2}$ which will be used at step 708 of the routine of FIG. 7. Therefore, the setting of the lean flag FL means that the catalyst converter 12 sufficiently absorbs $O_2$ molecules due to the $O_2$ storage effect thereof.

Figure 6:
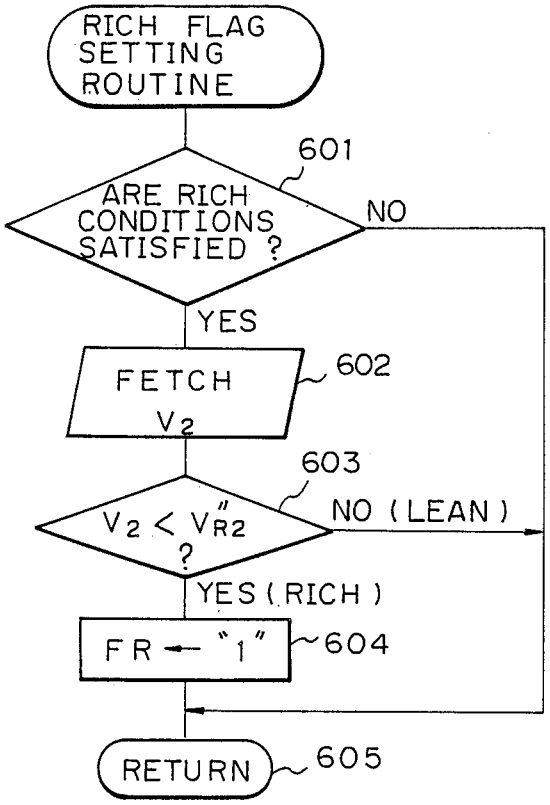

FIG. 6 is a routine for calculating a rich flag FR used in the routine of FIG. 7, executed at a predetermined time period such as 4 ms. That is, at step 601, it is determined whether or not the engine is in a rich driving state such as an FOTP state or an FPOWER state which indicates an open loop control state for the $O_2$ sensors 13 and 15. Only if the engine is in a rich driving state, does the control proceed to step 602, which performs an A/D conversion upon the output $V_2$ of the downstream-side $O_2$ sensor 15, and fetches the A/D converted value. Then, at step 603, the output $V_2$ is compared with a reference voltage $V_{R2}''$. As a result, only if $V_2 > V_{R2}''$ (rich), the control proceeds to step 604 which sets the lean flag FR. Then, the control proceeds to step 605 thus completing the routine of FIG. 6.

Thus, the rich flag FR is set by determining that the air-fuel ratio downstream of the catalyst converter 12 is sufficiently rich under the condition of a rich driving state as an open loop control state.

Note that the reference voltage $V_{R2}''$ at step 603 is higher, e.g., 0.5 to 0.7 V, compared with the reference voltage $V_{R2}$ which will be used at step 708 of the routine of FIG. 7. Therefore, the setting of the rich flag FL means that the catalyst converter 12 sufficiently expels $O_2$ molecules due to the $O_2$ storage effect thereof.

FIG. 7 is a routine for calculating a second air-fuel ratio feedback correction amount FAF2 in accordance with the output of the downstream-side $O_2$ sensor 15 executed at every predetermined time period such as 1 s.

At steps 701 through 705, it is determined whether or not all of the feedback control (closed-loop control) conditions by the downstream-side $O_2$ sensor 15 are satisfied. For example, at step 701, it is determined whether or not the feedback control conditions by the upstream-side $O_2$ sensor 13 are satisfied. At step 702, it is determined whether or not the coolant temperature THW is higher than 70° C. At step 703, it is determined whether or not the throttle valve 16 is open (LL="0"). At step 704, it is determined whether or not the output $V_2$ of the downstream-side $O_2$ sensor 15 has been once changed from the lean side to the rich side or vice versa. At step 705, it is determined whether or not a load parameter such as Q/Ne is larger than a predetermined value $X_1$. Of course, other feedback control conditions are introduced as occasion demands. For example, a condition whether or not the secondary air suction system is driven when the engine is in a deceleration state. However, an explanation of such other feedback control conditions is omitted.

If one or more of the feedback control conditions is not satisfied, the control directly proceeds to step 725, thereby carrying out an open-loop control operation. Note that, in this case, the amount FAF2 or a mean value $\overline{FAF2}$ thereof is stored in the backup RAM 106, and in an open-loop control operation, the value FAF2 or $\overline{FAF2}$ is read out of the backup RAM 106.

Contrary to the above, if all of the feedback control conditions are satisfied, the control proceeds to step 706. At step 706, an A/D conversion is performed upon the output voltage $V_2$ of the downstream-side $O_2$ sensor 15, and the A/D converted value thereof is then fetched from the A/D converter 101. Then, at step 707, the voltage $V_2$ is compared with the reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $VR_2$ (=0.55 V) is preferably higher than the reference voltage $V_{R1}$ (=0.45 V), in consideration of the difference in output characteristics and deterioration speed between the $O_2$ sensor 13 upstream of the catalyst converter 12 and the $O_2$ sensor 15 downstream of the catalyst converter 12. However, the voltage $V_{R2}$ can be voluntarily determined.

At step 707, if the air-fuel ratio upstream of the catalyst converter 12 is lean, the control proceeds to step 708 which resets a second air-fuel ratio flag F2. Alternatively, the control proceeds to the step 709, which sets the second air-fuel ratio flag F2.

At step 710, it is determined whether or not the lean flag FL is "1", and at step 711, it is determined whether or not the rich flag FR is "1". As a result when both of the lean flag FL and the rich flag FR are "0", the control proceeds to steps 712 to 714 which perform an integration operation upon the second air-fuel ratio correction amount FAF2. Contrary to the above, when the lean flag FL is "1", the control proceeds to step 715 and, when the rich flag FR is "1", the control proceeds to step 717.

Steps 712 through 714 will be explained. At step 712, it is determined whether or not the second air-fuel ratio flag F2 is "0" (lean). As a result, when the second air-fuel ratio flag F2 is "0" (lean), the control proceeds to step 713 which gradually increases the second air-fuel ratio correction amount FAF2 by an integration amount KI2 to move the air-fuel ratio to the rich side. Also, when the second air-fuel ratio flag F2 is "1" (rich), the control proceeds to step 714 which gradually decreases the second air-fuel ratio correction amount FAF2 by the integration amount KI2 to move the air-fuel ratio to the lean side.

At step 715, it is determined whether or not the second air-fuel ratio flag F2 is "1", i.e., whether or not the air-fuel ratio downstream of the catalyst converter 12 is switched from the lean side to the rich side after the lean flag FL is set. Only if switched, does the control proceed to step 716, which remarkably decreases the second air-fuel ratio correction amount FAF2 by a skip amount RS2 to move the air-fuel ratio to the lean side. Then, at step 717, the lean flag FL is reset. If not switched, the control proceeds to step 713 which gradually increases the second air-fuel ratio correction amount FAF2 by the integration amount KI2 to move the air-fuel ratio to the rich side.

At step 718, it is determined whether or not the second air-fuel ratio flag F2 is "0", i.e., whether or not the air-fuel ratio downstream of the catalyst converter 12 is switched from the rich side to the lean side after the rich flag FR is set. Only if switched, does the control proceed to step 719, which remarkably increases the second air-fuel ratio correction amount FAF2 by the skip amount RS2 to move the air-fuel ratio to the rich side. Then, at step 720, the rich flag FR is reset. If not switched, the control proceeds to step 714 which gradually decreases the second air-fuel ratio correction amount FAF2 by the integration amount KI2 to move the air-fuel ratio to the lean side.

Note that the skip amount RS2 is larger than the integration amount KI2.

The second correction amount FAF2 is guarded by a minimum value 0.8 at steps 721 and 722, and by a maximum value 1.2 at steps 723 and 724, thereby also preventing the controlled air-fuel ratio from becoming overrich or overlean.

The correction amount FAF2 is then stored in the backup RAM 106, thus completing this routine of FIG. 7 at step 725.

Figures 8A, 8B, 8C, 8D, 8E:
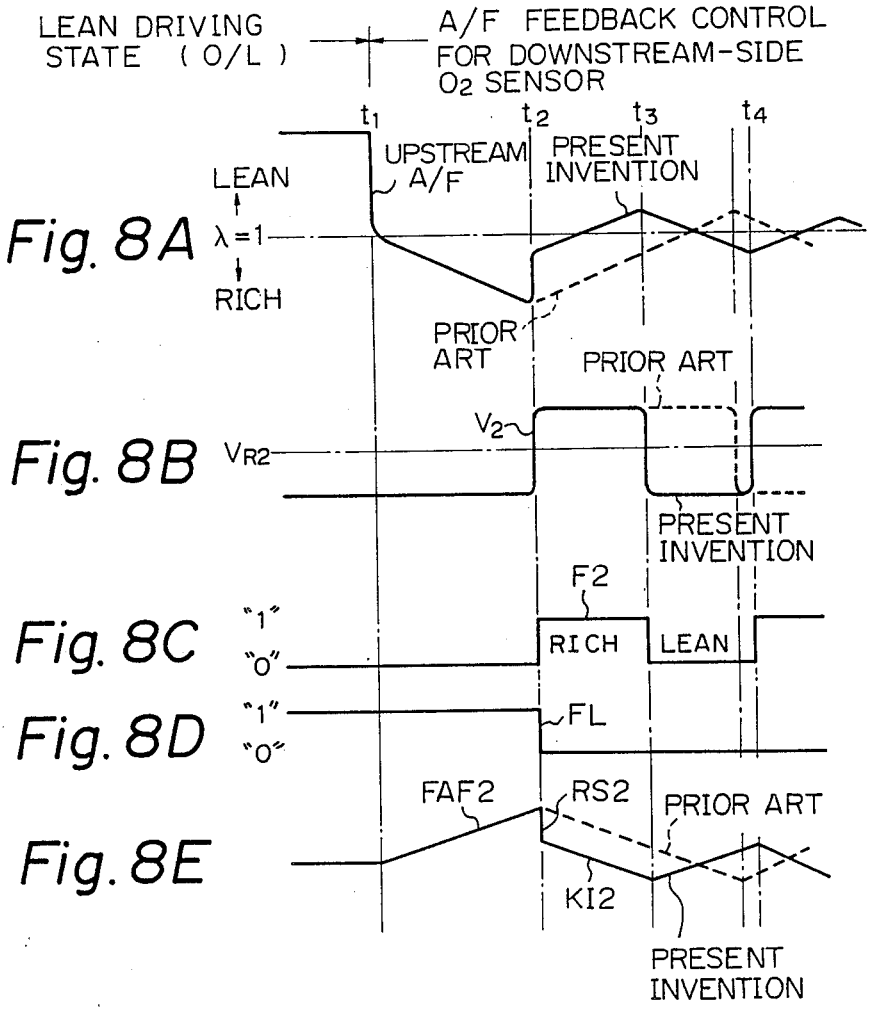
FIGS. 8A through 8E are timing diagrams explaining the flow chart of FIGS. 7 and 7A–7C.

The routine of FIG. 7 is further explained with reference to FIGS. 8A to 8E. Here, assuming that the engine is transferred from a lean driving state to an air-fuel ratio feedback control state for the stoichiometric air-fuel ratio by the downstream-side $O_2$ sensor 15. Namely, before time $t_1$, a lean driving state such as a fuel cut-off state continues for a long time. Therefore, as illustrated in FIG. 8A, the air-fuel ratio upstream of the catalyst converter 12 is lean, and the lean flag FL is made "1" by the routine of FIG. 5 as illustrated in FIG. 8D. In this case, the engine is in an open loop (O/L) control state for the downstream-side $O_2$ sensor 15, and the second air-fuel ratio correction amount FAF2 is fixed at a value as illustrated in FIG. 8E.

At time $t_1$, an air-fuel ratio feedback control by the downstream-side $O_2$ sensor 15 is initiated, and the air-fuel ratio upstream of the catalyst converter 12 is moved to the rich side as illustrated in FIG. 8A, but the downstream-side $O_2$ sensor 15 still indicates a lean output due to the $O_2$ storage effect of the catalyst converter 12 as illustrated in FIG. 8B. Therefore, since FL="1" and F2="0" (FIGS. 8C and 8D), the second air-fuel ratio correction amount FAF2 is gradually increased by steps 710, 715, and 713 of FIG. 7.

Next, at time $t_2$, when the air-fuel ratio downstream of the catalyst converter 12, i.e., the output $V_2$ of the downstream-side $O_2$ sensor 15, is switched from the lean side to the rich side, the second air-fuel ratio flag F2 is switched from "0" to "1" as illustrated in FIG. 8C. As a result, the second air-fuel ratio correction amount FAF2 is remarkably decreased by steps 710, 715, and 716 of FIG. 7. That is, although the air-fuel ratio upstream of the catalyst converter 12 is rich from time $t_1$ to time $t_2$ as illustrated in FIG. 8A, the switching of the air-fuel ratio (F2) downstream of the catalyst converter 12 is delayed by the $O_2$ molecules expelled from the catalyst converter 12, to overcorrect the second air-fuel ratio correction FAF2. This overcorrection of the second air-fuel ratio correction amount FAF2 is compensated by the skip operation of the second air-fuel ratio correction amount FAF2 at time $t_2$. Also, at time $t_2$, the lean flag FL is reset.

After time $t_2$, since the lean flag FL is "0", the second air-fuel ratio correction amount FAF2 is gradually increased or decreased by steps 712, 713, and 714.

Note that, if the above-mentioned open loop control state is established by a rich driving state such as an OTP fuel incremental state or a POWER fuel incremental state, operations similar to those illustrated in FIG. 8A through 8E are carried out.

Figure 9:
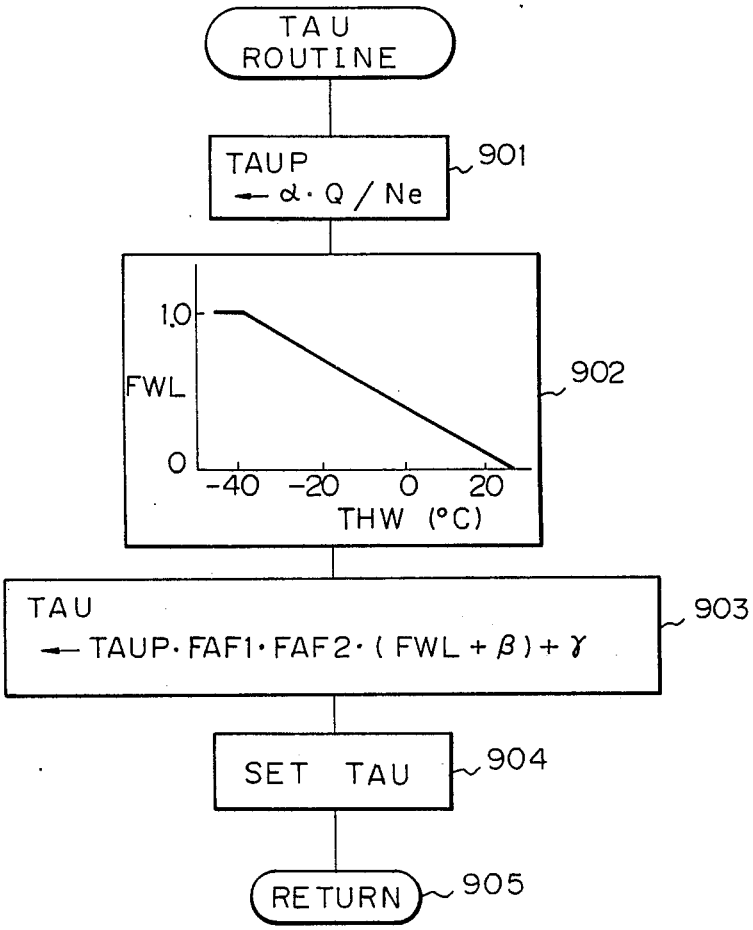

FIG. 9 is a routine for calculating a fuel injection amount TAU executed at every predetermined crank angle such as 360° CA. At step 901, a base fuel injection amount TAUP is calculated by using the intake air amount data Q and the engine speed data Ne stored in the RAM 105. That is, $$TAUP \leftarrow \alpha \cdot Q/Ne$$

where $\alpha$ is a constant. Then at step 902, a warming-up incremental amount FWL is calculated from a one-dimensional map stored in the ROM 104 by using the coolant temperature data THW stored in the RAM 105. Note that the warming-up incremental amount FWL decreases when the coolant temperature THW increases. At step 903, a final fuel injection amount TAU is calculated by $$TAU \leftarrow TAUP \cdot FAF1 \cdot FAF2 \cdot (FWL + \beta) + \gamma$$

where $\beta$ and $\gamma$ are correction factors determined by other parameters such as the voltage of the battery and the temperature of the intake air. At step 904, the final fuel injection amount TAU is set in the down counter 107, and in addition, the flip-flop 108 is set to initiate the activation of the fuel injection valve 7. Then, this routine is completed by step 905. Note that, as explained above, when a time period corresponding to the amount TAU has passed, the flip-flop 109 is reset by the carry-out signal of the down counter 108 to stop the activation of the fuel injection valve 7.

A double $O_2$ sensor system, in which an air-fuel ratio feedback control parameter of the first air-fuel ratio feedback control by the upstream-side $O_2$ sensor is variable, will be explained with reference to FIG. 10. In this case, the skip amounts RSR and RSL as the air-fuel ratio feedback control parameters are variable.

Figures 10, 10A:
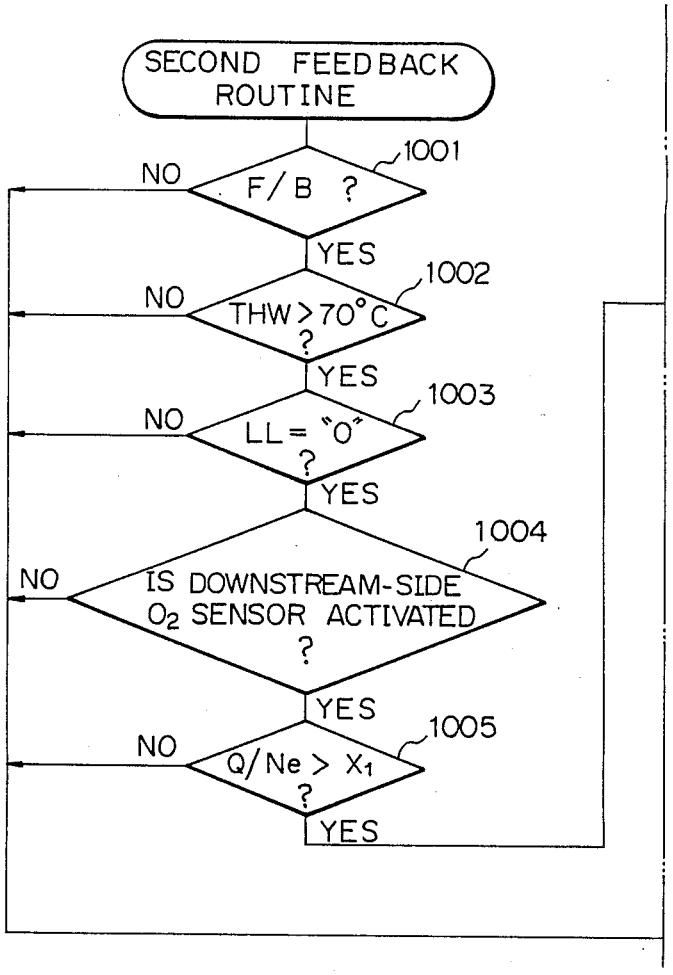
Figure 10B:
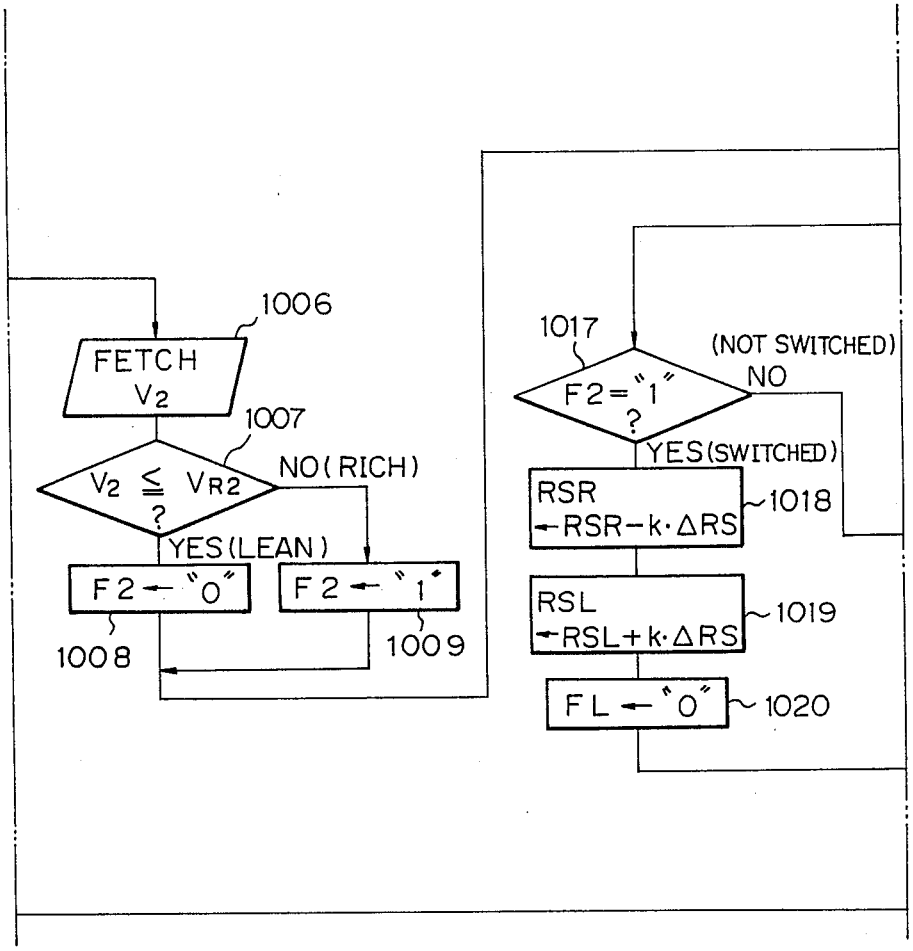
Figure 10C:
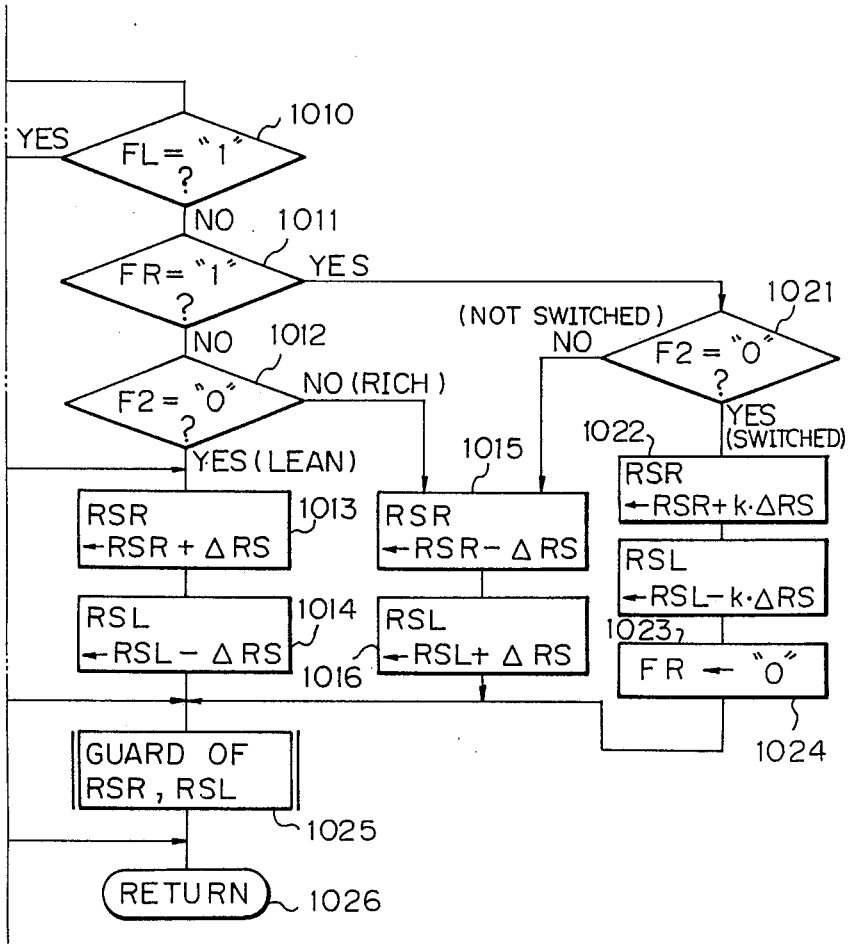

FIG. 10 is a routine for calculating the skip amounts RSR and RSL in accordance with the output $V_2$ of the downstream-side $O_2$ sensor 15 executed at every predetermined time period such as 1 s.

Steps 1001 through 1009 are the same as steps 701 through 709 of FIG. 7. That is, if one or more of the feedback control conditions is not satisfied, the control proceeds directly to step 1026, thereby carrying out an open-loop control operation. Note that, in this case, the amounts RSR and RSL or the mean values $\overline{RSR}$ and $\overline{RSL}$ thereof are stored in the backup RAM 106, and in an open-loop control operation, the values RSR and RSL or $\overline{RSR}$ and $\overline{RSL}$ are read out of the backup RAM 106.

Contrary to the above, if all of the feedback control conditions are satisfied, the control proceeds to steps 1006 through 1025.

At step 1006, an A/D conversion is performed upon the output voltage $V_2$ of the downstream-side $O_2$ sensor 15, and the A/D converted value thereof is then fetched from the A/D converter 101. Then, at step 1007, the voltage $V_2$ is compared with the reference voltage $V_{R2}$ thereby determining whether the current air-fuel ratio detected by the downstream-side $O_2$ sensor 15 is on the rich side or on the lean side with respect to the stoichiometric air-fuel ratio.

At step 1007, if the air-fuel ratio downstream of the catalyst converter 12 is lean, the control proceeds to step 1008 which resets the second air-fuel ratio flag F2. Alternatively, the control proceeds to the step 1009, which sets the second air-fuel ratio flag F2.

At step 1010, it is determined whether or not the lean flag FL is "1", and at step 1011, it is determined whether or not the rich flag FR is "1". As a result, when both the lean flag FL and the rich flag FR are "0", the control proceeds to steps 1012 to 1016 which renew the rich skip amount RSR and the lean skip amount RSL at a conventional speed ΔRS. Contrary to the above, when the lean flag FL is "1", the control proceeds to step 1017 and, when the rich flag FR is "1", the control proceeds to step 1021.

Steps 1012 through 1016 will be explained. At step 1012, it is determined whether or not the second air-fuel ratio flag F2 is "0" (lean). As a result, when the second air-fuel ratio flag F2 is "0" (lean), the control proceeds to step 1013 and 1014, and when the second air-fuel ratio flag is "1" (rich), the control proceeds to steps 1015 and 1016. At step 1013, the rich skip amount RSR is increased by ΔRS to move the air-fuel ratio to the rich side, and at step 1014, the lean skip amount RSL is decreased by ΔRS to further move the air-fuel ratio to the rich side. On the other hand, at step 1015, the rich skip amount RSR is decreased by ΔRS to move the air-fuel ratio to the lean side, and at step 1016, the lean skip amount RSL is increased by ΔRS to further move the air-fuel ratio to the lean side.

At step 1017, it is determined whether or not the second air-fuel ratio flag F2 is "1", i.e., whether or not the air-fuel ratio downstream of the catalyst converter 12 is switched from the lean side to the rich side after the lean flag FL is set. Only if switched, does the control proceed to steps 1018 and 1019 which greatly move the air-fuel ratio to the lean side. That is, $$RSR \leftarrow RSR - k \cdot \Delta RS$$

$$RSL \leftarrow RSL + k \cdot \Delta RS$$

where k is a constant such as 20 to 80. Then, at step 1020, the lean flag FL is reset. If not switched, the control proceeds to steps 1013 and 1014 which gradually change the skip amounts RSR and RSL by RS to the rich side.

At step 1021, it is determined whether or not the second air-fuel ratio flag F2 is "0", i.e., whether or not the air-fuel ratio downstream of the catalyst converter 12 is switched from the rich side to the lean side after the rich flag FR is set. Only if switched, does the control proceed to steps 1021 and 1022 which greatly moves the air-fuel ratio to the rich side. That is, $$RSR \leftarrow RSR + k \cdot \Delta RS$$

$$RSL \leftarrow RSL - k \cdot \Delta RS$$

Then, at step 1024, the rich flag FR is reset. If not switched, the control proceeds to steps 1015 and 1016 which gradually change the skip amounts RSR and RSL by RS to the lean side.

At step 1025, the skip amounts RSR and RSL are guarded by a maximum value MAX such as 7.5% and a minimum value MIN such as 2.5%. Note that the minimum value MIN is a level by which the transient characteristics of the skip operation using the amounts RSR and RSL can be maintained, and the maximum value MAX is a level by which the drivability is not deteriorated by the fluctuation of the air-fuel ratio.

The skip amounts RSR and RSL are then stored in the backup RAM 106, thereby completing this routine of FIG. 10 at step 1026.

Figures 11A, 11B, 11C, 11D, 11E, 11F:
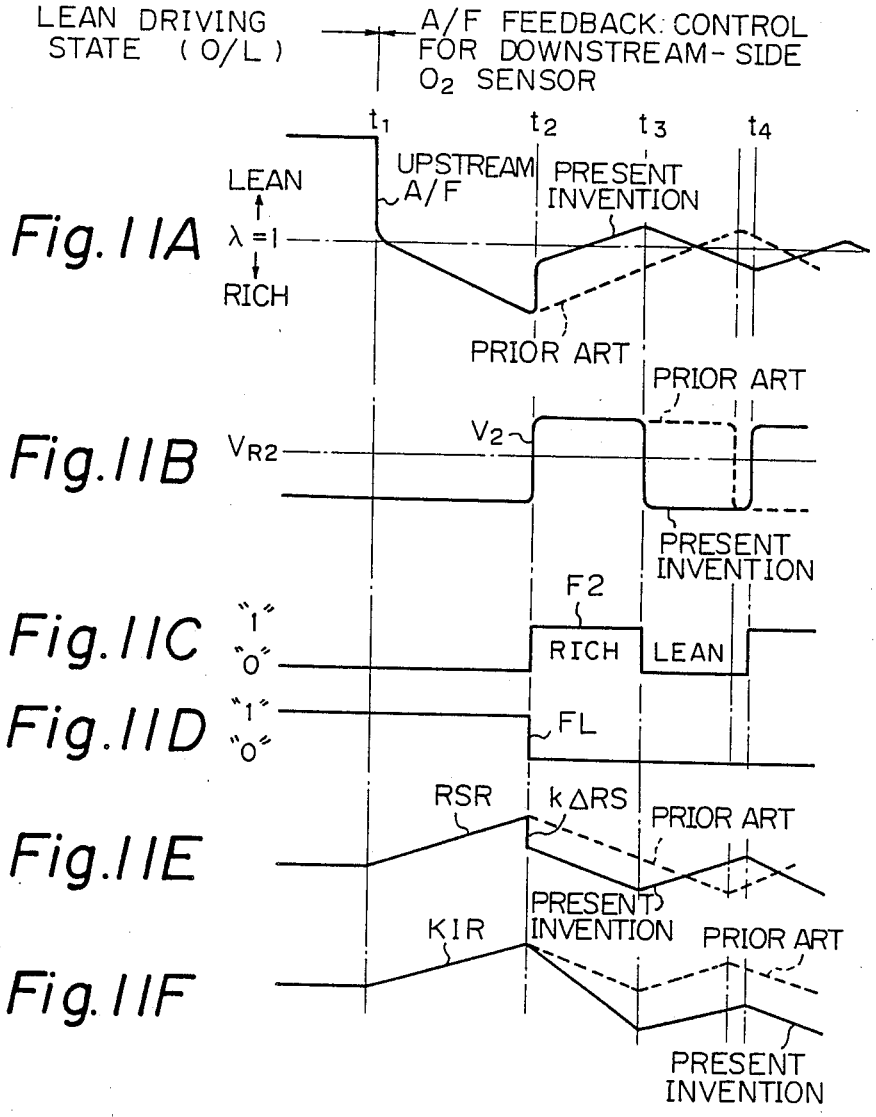
PRIOR ART Fig.11B
FIGS. 11A through 11F and 13 are timing diagrams explaining the flow chart of FIGS. 10 and 10A–10C.

The routine of FIG. 10 is further explained with reference to FIGS. 11A to 11E. Here, assuming that the engine is transferred from a lean driving state to an air-fuel ratio feedback control state for the stoichiometric air-fuel ratio by the downstream-side $O_2$ sensor 15. That is, before time $t_1$, a lean driving state such as a fuel cut-off state continues for a long time. Therefore, as illustrated in FIG. 11A, the air-fuel ratio upstream of the catalyst converter 12 is lean, and the lean flag FL is "1" by the routine of FIG. 5 as illustrated in FIG. 11D. In this case, the engine is in an open loop (O/L) control state for the downstream-side $O_2$ sensor 15, the rich skip amount RSR (also the lean skip amount RSL) is fixed at a value as illustrated in FIG. 11E.

At time $t_1$, an air-fuel ratio feedback control by the downstream-side $O_2$ sensor 15 is initiated, and the air-fuel ratio upstream of the catalyst converter 12 is moved to the rich side as illustrated in FIG. 11A, but the downstream-side $O_2$ sensor 15 still indicates a lean output due to the $O_2$ storage effect of the catalyst converter 12 as illustrated in FIG. 11B. Therefore, since FL="1" and F2="0" (FIGS. 11C and 11D), the rich skip amount RSR is gradually increased and the lean skip amount RSL is gradually decreased by steps 1010, 1017, 1013 and 1014 of FIG. 10.

Next, at time $t_2$, when the air-fuel ratio downstream of the catalyst converter 12, i.e., the output $V_2$ of the downstream-side $O_2$ sensor 15, is switched from the lean side to the rich side, the second air-fuel ratio flag F2 is switched from "0" to "1" as illustrated in FIG. 11C. As a result, the skip amounts RSR and RSL are remarkably changed at a speed of k·ΔRS by steps 1010, 1017 to 1020 of FIG. 10. That is, although the air-fuel ratio upstream of the catalyst converter 12 is rich from time $t_1$ to time $t_2$ as illustrated in FIG. 11A, the switching of the air-fuel ratio (F2) downstream of the catalyst converter 12 is delayed by the $O_2$ molecules expelled from the catalyst converter 12 to overcorrect the skip amounts RSR and RSL. This overcorrection of the skip amounts RSR and RSL is compensated by the skip operation of the skip amounts RSR and RSL at time $t_2$. Also, at time $t_2$, the lean flag FL is reset.

After time $t_2$, since the lean flag FL is "0", the skip amounts RSR and RSL are gradually increased or decreased by steps 1012 through 1016.

Note that, if the above-mentioned open loop control state is established by a rich driving state such as an OTP fuel incremental state or POWER fuel incremental state, operations similar to those illustrated in FIGS. 11A through 11E are carried out.

Note that the lean skip amount RSL is not present in FIG. 11E, but the change of the lean skip amount RSL is symmetrical to that of the rich skip amount RSR. That is, $$RSR + RSL = \text{definite}.$$

Figure 12:
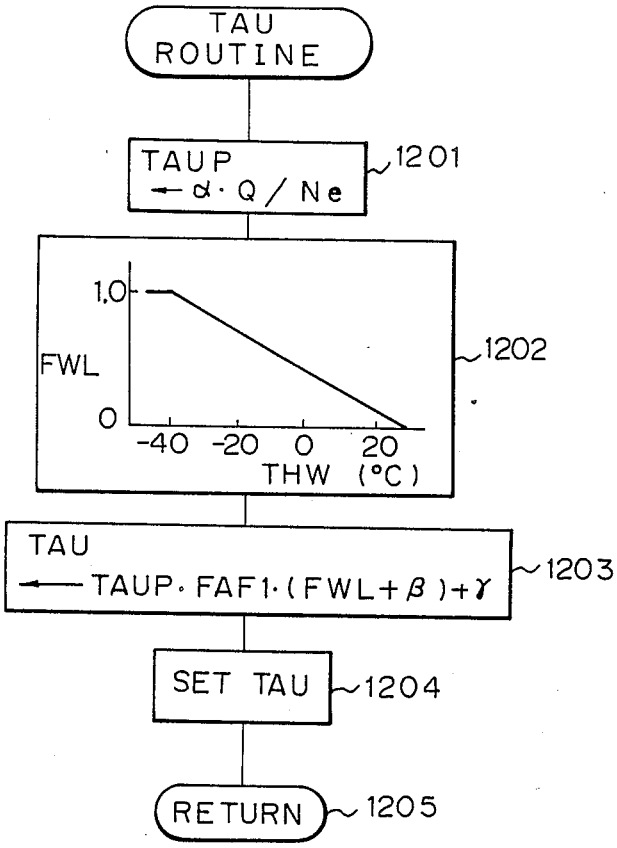

FIG. 12 is a routine for calculating a fuel injection amount TAU executed at every predetermined crank angle such as 360° CA. At step 1201, a base fuel injection amount TAUP is calculated by using the intake air amount data Q and the engine speed data Ne stored in the RAM 105. That is, $$TAUP \leftarrow \alpha \cdot Q/Ne$$

where α is a constant. Then at step 1202, a warming-up incremental amount FWL is calculated from a one-dimensional map by using the coolant temperature data THW stored in the RAM 105. Note that the warming-up incremental amount FWL decreased when the coolant temperature THW increases. At step 1203, a final fuel injectional amount TAU is calculated by $$TAU \leftarrow TAUP \cdot FAF1 \cdot (FWL + \beta) + \gamma$$

where $\beta$ and $\gamma$ are correction factors determined by other parameters such as the voltage of the battery and the temperature of the intake air. At step 1204, the final fuel injection amount TAU is set in the down counter 108, and in addition, the flip-flop 109 is set to initiate the activation of the fuel injection valve 7. This routine is then completed by step 1205. Note that, as explained above, when a time period corresponding to the amount TAU has passed, the flip-flop 109 is reset by the carry-out signal of the down counter 108 to stop the activation of the fuel injection valve 7.

Figure 13:
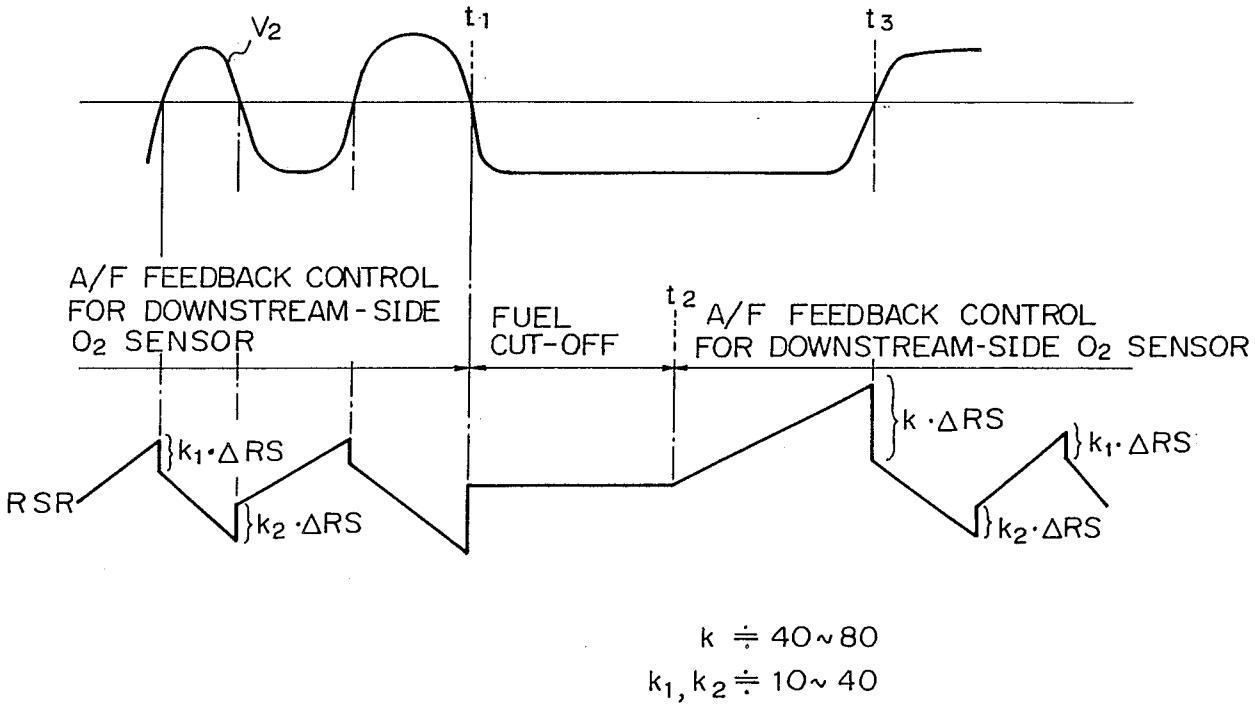

Note that the present invention can be applied to a double $O_2$ sensor system in which the skip amounts RSR and RSL are skipped at a switching of the output $V_2$ of the downstream-side $O_2$ sensor 15, thereby increasing the response speed. In this case, as illustrated in FIG. 13, the conventional coefficient $k_1$ and $k_2$ of the skip amounts $k_1 \cdot \Delta RS$ and $k_2 \cdot \Delta RS$ for the skip amounts RSR and RSL are 10 to 40, and the coefficient k of the skip amount $k \cdot \Delta RS$ for the skip amounts RSR and RSL at a first reversion ($t_3$) of the output of the downstream side $O_2$ sensor 15 after the engine enters into an air-fuel ratio feedback control for the downstream-side $O_2$ sensor 15 is 40 to 80.

The present invention is also applied to a single $O_2$ sensor system where only one $O_2$ sensor 15 is provided downstream of the catalyst converter 13. In this case, the routines of FIGS. 3, 10, and 12 are not used, while the routines of FIGS. 7 and 9 are used. Also, at step 903 of FIG. 9, the time period TAU is calculated by $$TAU \leftarrow TAUP \cdot FAF2 \cdot (FWL + \beta) + \gamma.$$

Note that the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. That is because the upstream-side $O_2$ sensor 13 has good response characteristics when compared with the downstream-side $O_2$ sensor.

Further, the present invention can be applied to a double $O_2$ sensor system in which other air-fuel ratio feedback control parameters, such as the integration amounts KIR and KIL, the delay time periods TDR and TDL, or the reference voltage $V_{R1}$, are variable. For example, in the integration amounts KIR and KIL, as illustrated in FIG. 11F, the speed of changing the rich integration amount KIR is increased from time $t_1$ to time $t_2$, to remarkably move the air-fuel ratio to the lean side. That is, this speed is increased between a first occurrence and a second occurrence of the switching of the output $V_2$ of the downstream-side $O_2$ sensor 15 after the engine enters into an air-fuel ratio feedback control by the downstream-side $O_2$ sensor 15.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage, or by adjusting the secondary air amount introduced into the exhaust system. In this case, the base fuel injection amount corresponding to TAUP at step 901 of FIG. 9 or at step 1201 or FIG. 12 is determined by the carburetor itself, i.e., the intake air negative pressure and the engine speed, and the air amount corresponding to TAU at step 903 of FIG. 9 or at step 1203 of FIG. 12.

Further, a CO sensor, a lean-mixture sensor or the like can be also used instead of the $O_2$ sensor.

As explained above, according to the present invention, even when the control is transferred from an open-loop control mode for the downstream-side air-fuel ratio sensor to an air-fuel ratio feedback control mode for the downstream-side air-fuel ratio sensor so that the switching of the output of the downstream-side air-fuel ratio sensor is delayed by the $O_2$ storage effect of the catalyst converter, the overcorrection of the air-fuel feedback control parameter or the like can be avoided, thus improving the emission, fuel consumption, and drivability characteristics.

I claim:

1. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

determining whether said engine is in an air-fuel ratio feedback control state for a stoichiometric air-fuel ratio by said downstream-side air-fuel ratio sensor or in an open loop control state for said upstream-side and downstream-side air-fuel ratio sensors;

calculating an air-fuel ratio correction amount in accordance with outputs of said upstream-side and downstream-side air-fuel ratio sensors when said engine is in said air-fuel ratio feedback control state;

determining whether or not a switching from the rich side to the lean side and a switching from the lean side occurs at an output of said downstream-side air-fuel ratio sensor;

changing the air-fuel ratio correction amount in accordance with the output of said upstream-side and said downstream-side air-fuel ratio sensors;

increasing the speed of change of said air-fuel ratio correction amount in accordance with the output of said downstream-side air-fuel ratio sensor for a predetermined time after a switching occurs in the output of said downstream-side air-fuel ratio sensor only the first time after said engine is switched from said open loop control state to said air-fuel ratio feedback control state; and adjusting an actual air-fuel ratio in accordance with said air-fuel ratio correction amount.

2. A method as set forth in claim 1, wherein said open loop control state is a lean air-fuel ratio driving state, said speed increasing step increasing the speed of change of said air-fuel ratio correction amount to the lean side.

3. A method as set forth in claim 1, wherein said open loop control state is a rich air-fuel ratio driving state, said speed increasing step increasing the speed of change of said air-fuel ratio correction amount to the rich side.

4. A method as set forth in claim 1, wherein said speed increasing step increases the speed of change of said air-fuel ratio correction amount only immediately after a first occurrence of said switching after said engine is switched from said open loop control state to said air-fuel ratio feedback control state.

5. A method as set forth in claim 1, wherein said speed increasing step increases the speed of change of said air-fuel ratio correction amount from a first occurrence of said switching to a second occurrence of said switching after said engine is switched from said open loop control state to said air-fuel ratio feedback control state.

6. A method as set forth in claim 1, wherein said air-fuel ratio correction amount calculating step comprises the steps of:

calculating a first air-fuel ratio correction amount in accordance with the output of said upstream-side air-fuel ratio sensor;

calculating a second air-fuel ratio correction amount in accordance with the output of said downstream-side air-fuel ratio sensor; and calculating said air-fuel ratio correction amount in accordance with said first and second air-fuel ratio correction amounts, said speed increasing step increasing the speed of change of said second air-fuel ratio correction amount.

7. A method as set forth in claim 1, wherein said air-fuel ratio correction amount calculating step comprises the steps of:

calculating an air-fuel ratio feedback control parameter in accordance with the output of said downstream-side air-fuel ratio sensor;

calculating said air-fuel ratio correction amount in accordance with the output of said upstream-side air-fuel ratio sensor and said air-fuel ratio feedback control parameter, said speed increasing step increasing the speed of change of said air-fuel ratio feedback control parameter.

8. A method as set forth in claim 7, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

9. A method as set forth in claim 7, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

10. A method as set forth in claim 7, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

11. A method as set forth in claim 7, Wherein said air-fuel ratio feedback control parameter is determined by a reference voltage with which the output of said upstream-side air-fuel ratio sensor is compared, thereby determining whether the air-fuel ratio is on the rich side or on the lean side.

12. A method for controlling an air-fuel ratio in an internal combustion engine having a catalyst converter for removing pollutants in the exhaust gas thereof, and a downstream-side air-fuel ratio sensor disposed downstream of said catalyst converter, for detecting a concentration of a specific component in the exhaust gas, comprising the steps of:

determining whether said engine is in an air-fuel ratio feedback control state for a stoichiometric air-fuel ratio by said downstream-side air-fuel ratio sensor or in an open loop control state for said downstream-side air-fuel ratio sensor;

calculating an air-fuel ratio correction amount in accordance with the output of said air-fuel ratio sensor when said engine is in said air-fuel ratio feedback control state;

determining whether or not a switching from the rich side to the lean side and a switching from the lean side occurs in the output of said downstream-side air-fuel ratio sensor;

changing the air-fuel ratio correction amount in accordance with the output of said upstream-side and said downstream-side air-fuel ratio sensors;

increasing the speed of change of said air-fuel ratio correction amount in accordance with the output of said downstream-side air-fuel ratio sensor for a predetermined time after a switching occurs in the output of said downstream-side air-fuel ratio sensor only the first time after said engine is switched from said open loop control state to said air-fuel ratio feedback control state; and adjusting an actual air-fuel ratio in accordance with said air-fuel ratio correction amount.

13. A method as set forth in claim 12, wherein said open loop control state is a lean air-fuel ratio driving state, said speed increasing step increasing the speed of change of said air-fuel ratio correction amount to the lean side.

14. A method as set forth in claim 12, wherein said open loop control state is a rich air-fuel ratio driving state, said speed increasing step increasing the speed of change of said air-fuel ratio correction amount to the rich side.

15. A method as set forth in claim 12, wherein said speed increasing step increases the speed of change of said air-fuel ratio correction amount only immediately after a first occurrence of said switching after said engine is switched from said open loop control state to said air-fuel ratio feedback control state.

16. A method as set forth in claim 12, wherein said speed increasing step increases the speed of change of said air-fuel ratio correction amount from a first occurrence of said switching to a second occurrence of said switching after said engine is switched from said open loop control state to said air-fuel ratio feedback control state.

17. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for determining whether said engine is in an air-fuel ratio feedback control state for a stoichiometric air-fuel ratio by said downstream-side air-fuel ratio sensor or in an open loop control state for said upstream-side and downstream-side air-fuel ratio sensors;

means for calculating an air-fuel ratio correlation amount in accordance with the outputs of said upstream-side and downstream-side air-fuel ratio sensors when said engine is in said air-fuel ratio feedback control state;

means for determining whether or not a switching from the rich side to the lean side and switching from the lean side occurs in the output of said downstream-side air-fuel ratio sensor ;

means for changing the air-fuel ratio correction amount in accordance with the output of said upstream-side and said downstream-side air-fuel ratio sensors;

means for increasing the speed of changing said air-fuel ratio correction amount in accordance with the output of said downstream-side air-fuel ratio sensor for a predetermined time after a switching occurs in the output of said downstream-side air-fuel ratio sensor only the first time after said engine is switched from said open loop control state to said air-fuel ratio feedback control state; and means for adjusting an actual air-fuel ratio in accordance with said air-fuel ratio correction amount.

18. An apparatus as set forth in claim 17, wherein said loop control state is a lean air-fuel ratio driving state, said speed increasing means increasing the speed of change of said air-fuel ratio correction amount to the lean side.

19. An apparatus as set forth in claim 17 wherein said open loop control state is a rich air-fuel ratio driving state, said speed increasing means increasing the speed of change of said air-fuel ratio correction amount to the rich side.

20. An apparatus as set forth in claim 17, wherein said speed increasing means increases the speed of change of said air-fuel ratio correction amount only immediately after a first occurrence of said switching after said engine is switched from said open loop control state to said air-fuel ratio feedback control state.

21. An apparatus as set forth in claim 17, wherein said speed increasing means increases the speed of change of said air-fuel ratio correction amount from a first occurrence of said switching to a second occurrence of said switching after said engine is switched from said open loop control state to said air-fuel ratio feedback control state.

22. An apparatus as set forth in claim 17, wherein said air-fuel ratio correction amount calculating means comprises:

means for calculating a first air-fuel ratio correction amount in accordance with the output of said upstream-side air-fuel ratio sensor;

means for calculating a second air-fuel ratio correction amount in accordance with the output of said downstream-side air-fuel ratio sensor; and means for calculating said air-fuel ratio correction amount in accordance with said first and second air-fuel ratio correction amounts;

said speed increasing means increasing the speed of change of said second air-fuel ratio correction amount.

23. An apparatus as set forth in claim 17, wherein said air-fuel ratio correction amount calculating means comprises:

means for calculating an air-fuel ratio feedback control parameter in accordance with the output of said downstream-side air-fuel ratio sensor;

means for calculating said air-fuel ratio correction amount in accordance with the output of said upstream-side and air-fuel ratio sensor and said air-fuel ratio feedback control parameter, means for said speed increasing step increasing the speed of change of said air-fuel ratio feedback control parameter.

24. An apparatus as set forth in claim 23, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

25. An apparatus as set forth in claim 23, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

26. An apparatus as set forth in claim 23, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

27. An apparatus as set forth in claim 23, wherein said air-fuel ratio feedback control parameter is determined by a reference voltage with which the output of said upstream-side air-fuel ratio sensor is compared, thereby determining whether the air-fuel ratio is on the rich side or on the lean side.

28. An apparatus for controlling an air-fuel ratio in an internal combustion engine having a catalyst converter for removing pollutants in the exhaust gas thereof, and a downstream-side air-fuel ratio sensor disposed downstream of said catalyst converter, for detecting a concentration of a specific component in the exhaust gas, comprising:

means for determining whether said engine is in an air-fuel ratio feedback control state for a stoichiometric air-fuel ratio by said downstream-side air-fuel ratio sensor or in an open loop control state for said downstream-side air-fuel ratio sensor;

means for calculating an air-fuel ratio correction amount in accordance with the output of said air-fuel ratio sensor when said engine is in said air-fuel ratio feedback control state;

means for determining whether or not a switching from the rich side to the lean side and a switching from the lean side occurs in the output of said downstream-side air-fuel ratio sensor;

means for changing the air-fuel ratio correction amount in accordance with the output of said upstream-side and said downstream-side air-fuel ratio sensors;

means for increasing the speed of change of said air-fuel ratio correction amount in accordance with the output of said downstream-side air-fuel ratio sensor for a predetermined time after a switching occurs in the output of said downstream-side air-fuel ratio sensor only the first time after said engine is switched from said open loop control state to said air-fuel ratio feedback control state; and means for adjusting an actual air-fuel ratio in accordance with said air-fuel ratio correction amount.

29. An apparatus as set forth in claim 28, wherein said open loop control state is a lean air-fuel ratio driving state, said speed increasing means increasing the speed of change of said air-fuel ratio correction amount to the lean side.

30. An apparatus as set forth in claim 28, wherein said open loop control state is a rich air-fuel ratio driving state, said speed increasing means increasing the speed of change of said air-fuel ratio correction amount to the rich side.

31. An apparatus as set forth in claim 28, wherein said speed increasing means increases the speed of change of said air-fuel ratio correction amount only immediately after a first occurrence of said switching after said engine is switched from said open loop control state to said air-fuel ratio feedback control state.

32. An apparatus as set forth in claim 28, wherein said speed increasing means increases the speed of change of said air-fuel ratio correction amount from a first occurrence of said switching to a second occurrence of said switching after said engine is switched from said open loop control state to said air-fuel ratio feedback control state.

* * * * *